United States Patent [19]

Stritzl et al.

[11] Patent Number: 4,615,536

[45] Date of Patent: Oct. 7, 1986

[54] HEEL HOLDER

[75] Inventors: Karl Stritzl; Henry Freisinger, both of Vienna; Franz Luschnig, Traiskirchen, all of Austria

[73] Assignee: TMC Corporation, Baar, Switzerland

[21] Appl. No.: 692,280

[22] Filed: Jan. 17, 1985

[30] Foreign Application Priority Data

Jan. 20, 1984 [AT] Austria ..... 186/84

[51] Int. Cl.[4] ..... A63C 9/08

[52] U.S. Cl. ..... 280/631

[58] Field of Search ..... 280/631, 632, 633, 636, 280/628, 626

[56] References Cited

U.S. PATENT DOCUMENTS

| | | | |
|---|---|---|---|
| 3,545,781 | 12/1970 | Salomon | 280/632 |
| 3,554,571 | 1/1971 | Smolka | 280/632 |
| 3,797,840 | 3/1974 | Unger | 280/626 |
| 3,964,757 | 6/1976 | Sittmann | 280/626 |
| 4,111,453 | 9/1978 | Krob | 280/626 |
| 4,496,167 | 1/1985 | Krob et al. | 280/632 |

FOREIGN PATENT DOCUMENTS

| | | | |
|---|---|---|---|
| 2340420 | 2/1975 | Fed. Rep. of Germany | 280/628 |
| 2535483 | 2/1977 | Fed. Rep. of Germany | 280/631 |

*Primary Examiner*—John J. Love
*Assistant Examiner*—Eric Culbreth
*Attorney, Agent, or Firm*—Flynn, Thiel, Boutell & Tanis

[57] ABSTRACT

A heel holder includes a base plate, a bearing block supported on the base plate, a binding housing pivotally supported on the bearing block, and a down-holding arrangement supported on the binding housing. A locking mechanism can releasably lock the binding housing in a downhill skiing position. A stepping spur is pivotally supported on the binding housing, and a locking member is pivotally supported on the stepping spur and can move to a locking position in which it engages the binding housing and holds the stepping spur in a stepping-in position. An upwardly projecting wall on the base plate engages the locking member as the binding housing moves into its downhill skiing position and pivots the locking member to an ineffective position in which the stepping spur can pivot away from its stepping-in position.

14 Claims, 3 Drawing Figures

HEEL HOLDER

FIELD OF THE INVENTION

The invention relates to a heel holder for releasably holding a ski shoe and, more particularly, to a heel holder which includes a base plate, a bearing block supported on the base plate, a locking member supported in the bearing block and biased by a locking spring, a binding housing pivotally supported on the bearing block for movement about a transverse axis and releasably held by the locking member in a downhill skiing position, a down-holding arrangement on the housing, and a swivel axle on the side of the housing which faces the ski shoe, the swivel axle pivotally supporting a stepping spur.

BACKGROUND OF THE INVENTION

Such a heel holder is disclosed in German Offenlegungsschrift No. 23 40 416 (corresponds to U.S. Pat. No. 3,964,757). In this heel holder, the stepping spur is constructed as a two-arm lever. The back side of this lever carries a controlling cam which can engage a projection on a slide member, the projection serving as a locking member and the slide member being biased by the locking spring. When the projection is in the region of the stepping spur which lies above its swivel axis, which corresponds with the skiing position of the heel holder, then the stepping spur does not engage the ski shoe. However, when the projection engages the region of the controlling cam of the stepping spur which is below the swivel axis, then the stepping spur is pressed by the locking spring against the underside of the ski shoe. The contact between the stepping spur and ski shoe therefore occurs with friction.

This embodiment of a stepping spur has various disadvantages. For example, it cannot be easily applied to all heel holders, but only to those in which the locking member biased by the locking spring is arranged on a piston which is movable parallel to the upper side of the ski. Furthermore, the ski shoe must be provided on a relatively thick base plate in order to make possible a swivelling of the stepping spur relative to the upper side of the ski without the upper side of the ski being provided with a recess. Finally, the axis of the stepping spur is exposed to the full pressure of the locking spring, which leads to rapid wear of the heelholder.

In a different heel holder, the stepping spur is guided movably along the wall of the binding housing which faces the ski shoe (all Austrian Pat. No. 287 553), which corresponds to U.S. Pat. No. 3,554,571. The stepping spur is biased by a spring which urges it toward the down-holding arrangement. Due to this spring, the distance between the stepping spur and down-holding arrangement can increase during stepping in and also during an automatic release. In the skiing position of the heel holder, however, the ski shoe is gripped between the stepping spur and the down-holding means by the urging of the spring.

The invention has as one goal to do away with the disadvantages of the known designs and to provide an arrangement of a stepping spur which can be applied in almost all heel holders. The ski shoe in the inventive arrangement, in the skiing position of the heel holder, is to be free of the influence of the stepping spur, but at the start of the stepping-in operation the stepping spur is to be held in a forwardly swung position.

SUMMARY OF THE INVENTION

This goal is achieved by providing a heel holder of the above-mentioned type in which the stepping spur can be releasably locked, during the portion of the stepping-in movement which lies above a release point of the locking mechanism, against movement relative to the housing away from a position swivelled toward the ski shoe, and in which a control mechanism is provided which releases the stepping spur just before the down-holding arrangement reaches its downhill skiing position.

BRIEF DESCRIPTION OF THE DRAWINGS

One exemplary embodiment of the subject matter of the invention is diagrammatically shown in the drawings. In the drawings.

DETAILED DESCRIPTION

Figure 1:
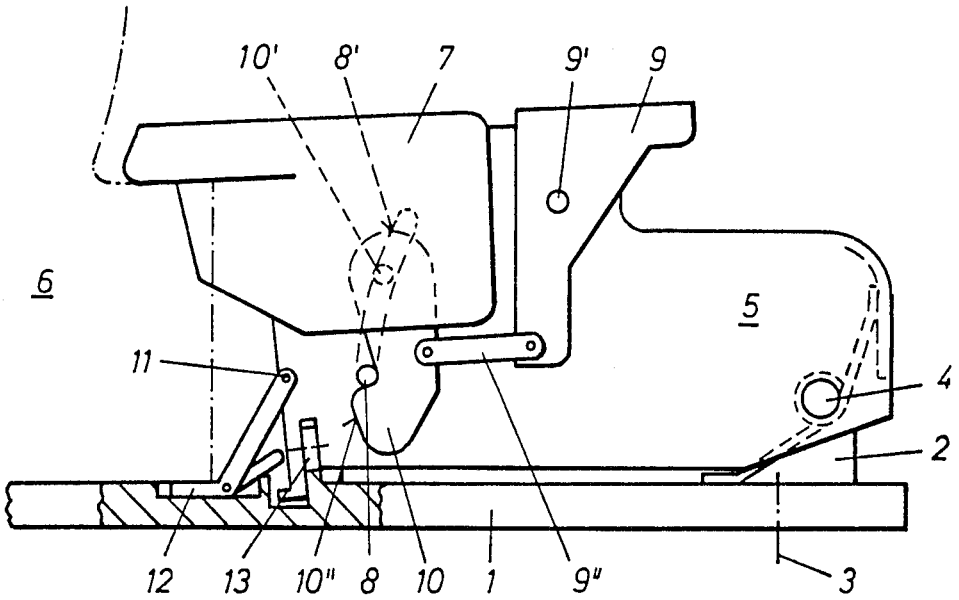
FIG. 1 is a side view, partially in section, of a heel holder which embodies the invention and is in the downhill skiing position.

The illustrated heel holder has a base plate 1 on which a bearing block 2 is supported for pivotal movement about a vertical axis 3. The bearing block 2 carries a transverse axle 4 which pivotally supports a downwardly open binding housing 5. The housing 5 has at its end adjacent a ski shoe 6 a down-holding arrangement 7. An arc-shaped slot 8' is provided in the bearing block 2, in which slot a pin 8 is slidably guided.

Figure 3:
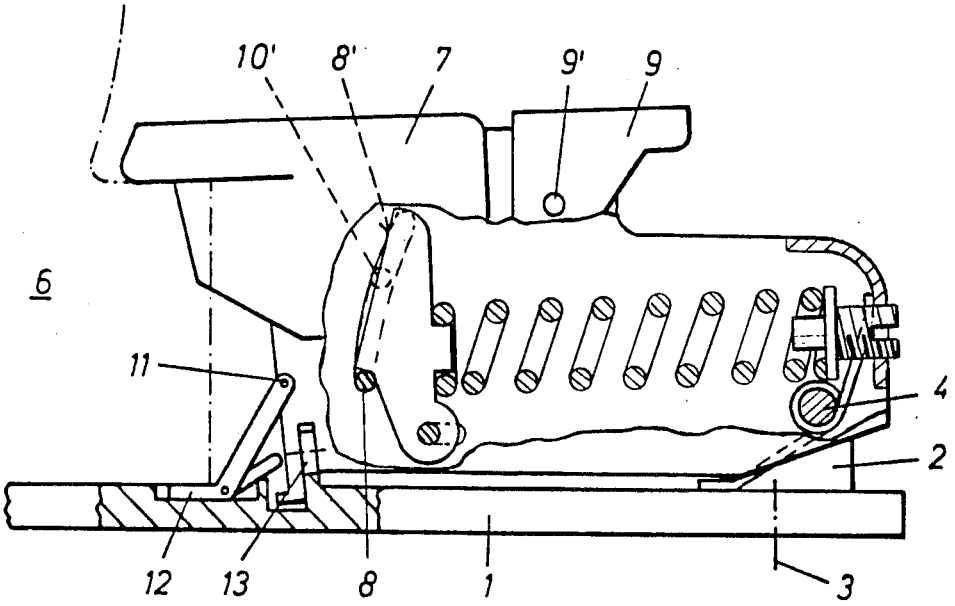
FIG. 3 is a fragmentary side view similar to FIG. 1 showing a conventional locking mechanism which is provided within the heel holder of FIG. 1.

The pin 8 is releasably held against upward movement by a conventional locking mechanism which includes a controlling cam 25 (FIG. 3) arranged on a lever 26 biased by a locking spring 27. The locking spring can be adjusted for different magnitudes of release forces. The lever 26 is supported swingably inside of the bearing block 2, and the locking spring 27 is arranged in a recess in the bearing block 2.

The mechanism biased by the locking spring is not discussed in great detail because this mechanism is actually known and is not a part of the present invention.

Each leg of a U-shaped release lever 9 is supported pivotally on an axle 9', and each of two one-arm levers 10 is supported pivotally on an axle 10' on a respective side of the binding housing 5. Each lever 10 is connected to the release lever 9 by a respective hinge plate 9'' and is biased in a clockwise direction in FIG. 1 by a torsion spring which is not illustrated. The lever 10 has a controlling cam 10'' on its front side, which controlling cam 10'' is engageable with the pin 8.

The binding housing 5 has a wall 5' which is adjacent the ski shoe 6 and supports a transverse axle 11, which in turn pivotally supports a stepping spur 12. The wall 5' extends downwardly beyond the bottom of the binding housing 5 and has at the lower end of this extension a forward projection 5''. Furthermore, a roller 13 is supported on the inner side of the wall 5' on an axle 13' which is parallel to the longitudinal axis of the ski, and the roller 13 can roll along a guide rail 14 on the base plate 1 when the bearing block 2 pivots about the vertical axis 3. The guide rail 14 is arcuate in a top view.

The stepping spur 12 is a one-arm lever which is bent in its center region to form an obtuse angle. The stepping spur 12 has at its bend a swivel axle 15 which pivotally supports a lock member 16 which is biased to pivot clockwise by a torsion spring 17.

Two recesses 18 and 19 are provided in the base plate 1, between which there is provided an upwardly projecting wall 20 which serves as a stop for the lock member 16. The recess 18 can receive the bent or outer end of the stepping spur 12, and the recess 19 can receive the extension of the wall 5' which carries the projection 5''.

Figure 2:
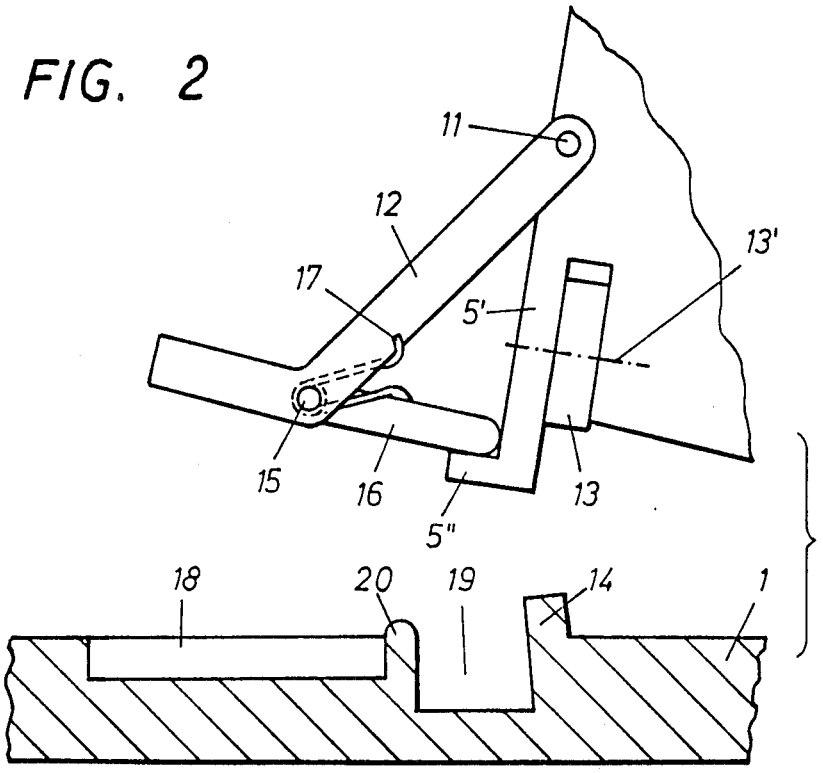
FIG. 2 is an enlarged view similar to FIG. 1 of a portion of the structure shown in FIG. 1, showing the heel holder in its stepping-in position.

The inventive heel holder works as follows. Before the ski shoe 6 steps into the heel holder, the stepping spur 12 is in the position illustrated in FIG. 2. In this position, the stepping spur 12 is swung toward the tip of the ski, and the lock member 16 is urged by the torsion spring 17 to a position against the projection 5'', in which it has passed a dead-center position. The stepping spur 12 therefore is prevented from immediately pivoting in a counterclockwise direction when the ski shoe 6 is placed onto the stepping spur.

When the binding housing 5 is then swung by the ski boot toward the upper side of the ski, the angular position of the stepping spur 12 is maintained until after the binding housing 5 has passed the release point of the locking mechanism of the heel holder. As soon as this point has been passed, the down-holding arrangement 7, under the influence of the locking spring, snaps into its downhill skiing position (FIG. 1). The stepping spur 12 is thereafter unnecessary. For this reason, during movement of the binding housing 5 after the release point is passed, the upper end of the wall 20 engages the lock member 16 and pivots it in a counterclockwise direction against the urging of the torsion spring 17, which in turn permits a counterclockwise swivelling of the stepping spur 12.

As a result, in the downhill skiing position of the heel holder, the heel of the ski shoe 6 is held only between the down-holding arrangement 7 and the base plate 1, and not between the down-holding arrangement 7 and the stepping spur 12. Through this, a release of the ski shoe 6 in the event of a fall is substantially eased. This is of particular importance in ski bindings which have a rigid front jaw, since the ski shoe 6 must release easily from the heel holder during a pure twisting fall. In this case, the guide rail 14 is provided only with two ramps arranged in a V-shape and does not have a locking recess between the ramps, so that an opening of the heel holder can take place even when a force acts onto the ski shoe 6 in a direction which is parallel to the upper side of the ski.

Of course, the invention is not limited to the exemplary embodiment which is illustrated in the drawing and described above. Rather, variations and modifications, including the rearrangement of parts, are possible without leaving the scope of the invention. For example, it is possible to equip heel holders which differ in design from the illustrated heel holder with a stepping spur according to the invention. The inventive heel holder could also be arranged on a sole plate which at its front end carries a front jaw and which is pivotal relative to the ski about an axis perpendicular to the upper side of the ski.

The embodiment of the invention in which an exclusive property or privilege is claimed are defined as follows:

1. A heel holder, comprising: a base plate; a bearing block supported on the base plate; a first locking member movably supported on the bearing block and biased by a locking spring; a binding housing which is pivotally supported on the bearing block for movement about a transverse axis between downhill skiing and release positions and which, in the downhill skiing position, is releasably held by the first locking member against movement toward the release position; down-holding means supported on the binding housing; a swivel axle on a side of the binding housing which faces the ski shoe, the swivel axle pivotally supporting a stepping spur below the down-holding means for movement between a steeping-in position and a released position, the stepping spur moving away from the down-holding means as it moves from its stepping-in position to its released position; locking means for releasably holding the stepping spur against movement away from its stepping-in position when the binding housing is in its release position; and control means for releasing the locking means during movement of the binding housing toward the downhill skiing position and just before the binding housing reaches the downhill skiing position; wherein the stepping spur is a one-arm lever which is bent to form an obtuse angle and carries a hinge axle at its bend, wherein the locking means includes, pivotally supported on the hinge axle, a second locking member which effects the releasable locking of the stepping spur, and wherein the control means includes a stop which is arranged on the base plate and which, shortly before the downhill skiing position of the housing is reached, engages the second locking member and swings it from a locking position into an ineffective position.

2. The heel holder according to claim 1, wherein the second locking member is biased by a spring which urges it into its locking position.

3. The heel holder according to claim 1, wherein a front wall of the housing extends downwardly beyond a bottom of the housing and carries a projection which points forwardly toward the ski shoe, which projection is engaged by the second locking member when the second locking member is in its locking position, the locking position lying just beyond a deadcenter position of the second locking member with respect to the front wall.

4. The heel holder according to claim 3, wherein the base plate has two recesses, one of which can receive a free end of the stepping spur and the other of which can receive the projection on the front wall of the housing, and wherein the stop on the base plate is a wall between the two recesses.

5. In a heel holder which includes: a base plate; a bearing block which is supported on the base plate; a first locking member which is movably supported on the bearing block and is biased by a locking spring; a binding housing which is pivotally supported on the bearing block for movement about a transverse axis between release and downhill skiing positions and which, in its downhill skiing position, is releasably held against movement toward its release position by the first locking member; down-holding means supported on the binding housing; and a swivel axle which pivotally supports a stepping spur and is provided on a side of the binding housing nearest the ski shoe; the improvement comprising wherein the stepping spur is a one-arm lever and can be releasably locked by a pivotally supported second locking member, when the binding housing is in its release position and during a portion of the stepping-in movement of the binding housing from its release position to its downhill skiing position, in a stepping-in position in which it is swivelled toward the ski shoe relative to the housing, and wherein on the base plate there is a stop which, shortly before the housing reaches its downhill skiing position, engages the second locking member and pivots it from a locking position into an ineffective position.

6. The heel holder according to claim 5, wherein the stepping spur is bent to form an obtuse angle and carries a hinge axle at its bend, which hinge axle pivotally supports the second locking member.

7. The heel holder according to claim 6, wherein the second locking member is biased by a spring which yieldably urges it toward its locking position.

8. The heel holder according to claim 6, wherein a front wall of the housing extends downwardly beyond a bottom of the housing and carries a projection which points forwardly toward the ski shoe, which projection is engaged by the second locking member when the second locking member is in its locking position, the locking position lying just beyond a deadcenter position of the second locking member with respect to the front wall.

9. The heel holder according to claim 8, including two recesses arranged in the base plate, one of which can receive a free end of the stepping spur and the other of which can receive the projection on the front wall of the housing, a wall located between the two recesses being the stop on the base plate which can pivot the second locking member.

10. A heel holder, comprising: a base plate; a binding housing and means supporting said binding housing for generally vertical movement relative to said base plate between a downhill skiing position adjacent said base plate and a release position spaced above said base plate, said binding housing having thereon a down-holding member engageable with an upper side of a sole of a ski boot; releasable locking means for yieldably resisting upward movement of said binding housing away from said downhill skiing position; a stepping spur supported on said binding housing at a location spaced below said down-holding member for movement between a stepping-in position and a released position, said stepping spur having a portion which can engage an underside of a sole of a ski boot and movement of said stepping spur from its stepping-in position to its released position effecting approximately downward movement of said portion thereof away from said down-holding member; and holding means for releasably holding said stepping spur in its stepping-in position when said binding housing is in said release position and during movement of said binding housing away from said release position toward said downhill skiing position, including a locking member supported on said stepping spur for movement between a locking position in which said locking member obstructs movement of said stepping spur away from its stepping-in position and a release position in which said stepping spur is free to move away from its stepping-in position toward its released position, said holding means further including means for moving said locking member away from its locking position toward its release position as said binding housing moves from its release position to its downhill skiing position.

11. The heel holder according to claim 10, wherein said stepping spur is pivotally supported on said binding housing for movement about a transverse horizontal first pivot axis, said portion of said stepping spur being spaced radially from said first pivot axis, wherein said locking member is pivotally supported on said stepping spur for movement about a transverse horizontal second pivot axis, and wherein in said locking position an end of said locking member remote from said second pivot axis engages said binding housing.

12. The heel holder according to claim 11, wherein said binding housing has an approximately vertically extending front surface thereon facing toward a ski shoe releasably clamped in the heel holder and has a projection which extends outwardly from the lower end of said front surface in a direction toward the ski shoe, wherein said end of said locking member remote from said second pivot axis slidably engages said front surface and engages said projection when said locking member is in its locking position, and wherein said locking member extends substantially perpendicular to said front surface when said end thereof is spaced a small distance from said projection on said binding housing.

13. The heel holder according to claim 12, including resilient means for yieldably urging pivotal movement of said locking member in a direction from said release position toward said locking position thereof; and wherein said means for moving said locking member away from its locking position includes an upright step which is provided on said base plate and which engages said locking member at a point during downward movement of said binding housing in which said binding housing is spaced from said downhill skiing position,

14. The heel holder according to claim 13, wherein said resilient means includes a torsion spring having two legs, one of said legs being supported on said stepping spur and the other of said legs being supported on said locking member; and wherein said stepping spur includes first and second portions which extend at an obtuse angle to each other, said locking member being pivotally supported on said stepping spur in the region of the intersection of said first and second portions, said stepping spur being pivotally supported on said binding housing at an end of said first portion remote from said second portion, and said second portion being said portion of said stepping spur which can engage an underside of a sole of a ski boot.

* * * * *